US008038235B2

(12) United States Patent
Lowery et al.

(10) Patent No.: US 8,038,235 B2
(45) Date of Patent: Oct. 18, 2011

(54) REFRIGERATOR WITH TRAY ON TOP

(75) Inventors: Frederick M. Lowery, Urbandale, IA (US); Kenneth C. Boyle, Newton, IA (US); Rob Brueckner, Johnston, IA (US); Michael Kopczewski, Grove City, OH (US); Ryan Berger, Columbus, OH (US); Barry Markwick, Edmonds, WA (US)

(73) Assignee: Maytag Corporation, Benton Harbor, MI (US)

( * ) Notice: Subject to any disclaimer, the term of this patent is extended or adjusted under 35 U.S.C. 154(b) by 840 days.

(21) Appl. No.: 11/269,487

(22) Filed: Nov. 8, 2005

(65) Prior Publication Data

US 2006/0108902 A1 May 25, 2006

Related U.S. Application Data

(60) Provisional application No. 60/626,001, filed on Nov. 8, 2004.

(51) Int. Cl.
*A47B 96/00* (2006.01)
*A47B 87/02* (2006.01)

(52) U.S. Cl. ..... 312/401; 312/198; 312/290

(58) Field of Classification Search ..... 312/401, 312/408, 116, 237, 107, 198, 249.1, 249.8, 312/290; 62/258, 440, 326, 327, 328, 457.1; D15/81, 89; 40/606.04, 606.07, 611.01; 220/592.01, 592.02, 592.03
See application file for complete search history.

(56) References Cited

U.S. PATENT DOCUMENTS

| | | | | | |
|---|---|---|---|---|---|
| 1,095,023 | A | * | 4/1914 | Parker | 62/441 |
| 2,554,290 | A | * | 5/1951 | Becker | 62/329 |
| 2,663,391 | A | | 12/1953 | Kuhns | |
| 3,364,882 | A | | 1/1968 | Merrick | |
| 3,974,658 | A | * | 8/1976 | Starrett | 62/60 |
| 4,002,384 | A | | 1/1977 | Brown et al. | |
| 4,375,758 | A | | 3/1983 | Simmons | |
| 4,581,902 | A | | 4/1986 | Starck et al. | |
| 4,619,363 | A | * | 10/1986 | Wolfseder | 206/373 |
| 4,759,193 | A | * | 7/1988 | Dehring | 62/258 |
| 4,866,572 | A | * | 9/1989 | Blodgett | 361/735 |
| 4,871,217 | A | * | 10/1989 | Taylor et al. | 312/216 |
| 5,071,024 | A | * | 12/1991 | Delmerico et al. | 220/832 |
| D342,744 | S | * | 12/1993 | Renner | D15/81 |
| 5,307,647 | A | | 5/1994 | McClure | |
| 5,319,937 | A | | 6/1994 | Fritsch et al. | |
| 5,415,010 | A | | 5/1995 | Woo | |
| 5,454,478 | A | * | 10/1995 | Everson | 220/23.83 |
| D368,387 | S | | 4/1996 | Bureau | |
| 5,509,225 | A | * | 4/1996 | Minh et al. | 40/606.02 |
| 5,660,296 | A | | 8/1997 | Greenwich | |

(Continued)

FOREIGN PATENT DOCUMENTS

JP 2004/159870 A2 11/2002

(Continued)

*Primary Examiner* — James O Hansen
(74) *Attorney, Agent, or Firm* — John W. Morrison; Kirk W. Goodwin; Diederiks & Whitelaw, PLC

(57) ABSTRACT

A compact portable refrigerator includes caster wheels on its bottom and a removable storage tray on its top. The storage tray is well suited for containing ice and beverage containers. A lid may be provided to selectively enclose and cover the storage tray. Removable display panels may be provided on a door of the refrigerator. Back lighting may be provided to enhance the appearance of the display panels.

9 Claims, 7 Drawing Sheets

U.S. PATENT DOCUMENTS

| | | | | |
|---|---|---|---|---|
| 5,816,674 | A * | 10/1998 | Manos et al. | 312/290 |
| 5,941,077 | A | 8/1999 | Safyan | |
| 5,957,321 | A * | 9/1999 | Jones | 220/533 |
| 5,957,557 | A * | 9/1999 | Langer et al. | 312/223.6 |
| 6,067,738 | A * | 5/2000 | Zeligson | 40/606.03 |
| 6,230,426 | B1 * | 5/2001 | Fakhoury et al. | 40/606.02 |
| 6,532,756 | B1 | 3/2003 | Wang et al. | |
| 6,550,168 | B1 * | 4/2003 | Campos | 40/406 |
| 6,658,857 | B1 * | 12/2003 | George | 62/3.3 |
| 6,777,654 | B1 * | 8/2004 | Greenburg | 219/679 |
| 6,782,711 | B2 | 8/2004 | Abfalter | |
| D537,456 | S * | 2/2007 | Davis | D15/81 |
| 7,288,745 | B2 * | 10/2007 | Colonna | 219/439 |
| 2003/0080655 | A1 * | 5/2003 | Goldberg | 312/290 |
| 2003/0151339 | A1 * | 8/2003 | Reed et al. | 312/405 |
| 2004/0035142 | A1 * | 2/2004 | Yoon et al. | 62/441 |

FOREIGN PATENT DOCUMENTS

| | | | |
|---|---|---|---|
| JP | 2004/108773 | A2 | 1/2004 |

* cited by examiner

REFRIGERATOR WITH TRAY ON TOP

This invention is a non-provisional that claims priority from U.S. Provisional Application No. 60/626,001, filed Nov. 8, 2004, the entire contents of which are hereby incorporated by reference.

FIELD OF INVENTION

This invention relates generally to refrigerators, and more specifically to a refrigerator having a serving tray on the refrigerator.

BACKGROUND

Refrigerators that include an insulated cabinet with a door providing access to a refrigerated storage space are well known. Compact refrigerators such as are commonly used in dorm rooms and the like, are also well known. These refrigerators may include a variety of sizes and styles. They may include only a single door opening to a single refrigerated compartment, or may include both a fresh food compartment and a freezer portion. Generally the top of the refrigerator is a flat planar surface that is integrated with and permanently affixed to the cabinet.

When people entertain there is often a need or desire to provide iced containers of beverages or other items in a serving container, such as an ice bucket or serving tray. Compact refrigerators are often used in areas where space is limited, and storage is needed for things such as digital video disks (DVDs), compact disks (CDs), and unrefrigerated snacks. Therefore, it would be beneficial if a refrigerator included compact storage space for DVDs, CDs and the like as well as a serving container that could be used to served iced beverage containers. Most preferably such a refrigerator could incorporate an attractive or desired appearance.

SUMMARY OF THE INVENTION

An objective of the present invention is to provide a refrigerator that includes a removable storage tray.

A further objective of the present invention is to provide a compact refrigerator that includes a removable, backlit display panel.

To that end, the proposed invention is directed to a compact refrigerator that includes a refrigerated cabinet portion and a door. A storage tray is provided at the top of the cabinet. At least three wheels may be attached to the bottom of the cabinet. In preferred embodiments the door of the refrigerator may include a removable display panel. The display panel may be translucent, and the door may include some form of back lighting to enhance the appearance of the display panel. The storage tray may be removable so that it may be used as a serving tray. The storage tray may include a flat hinged cover to cover and protect items stored within the tray, and to provide a flat surface on the top of the refrigerator.

DETAILED DESCRIPTION OF PREFERRED EMBODIMENTS

Figure 1:
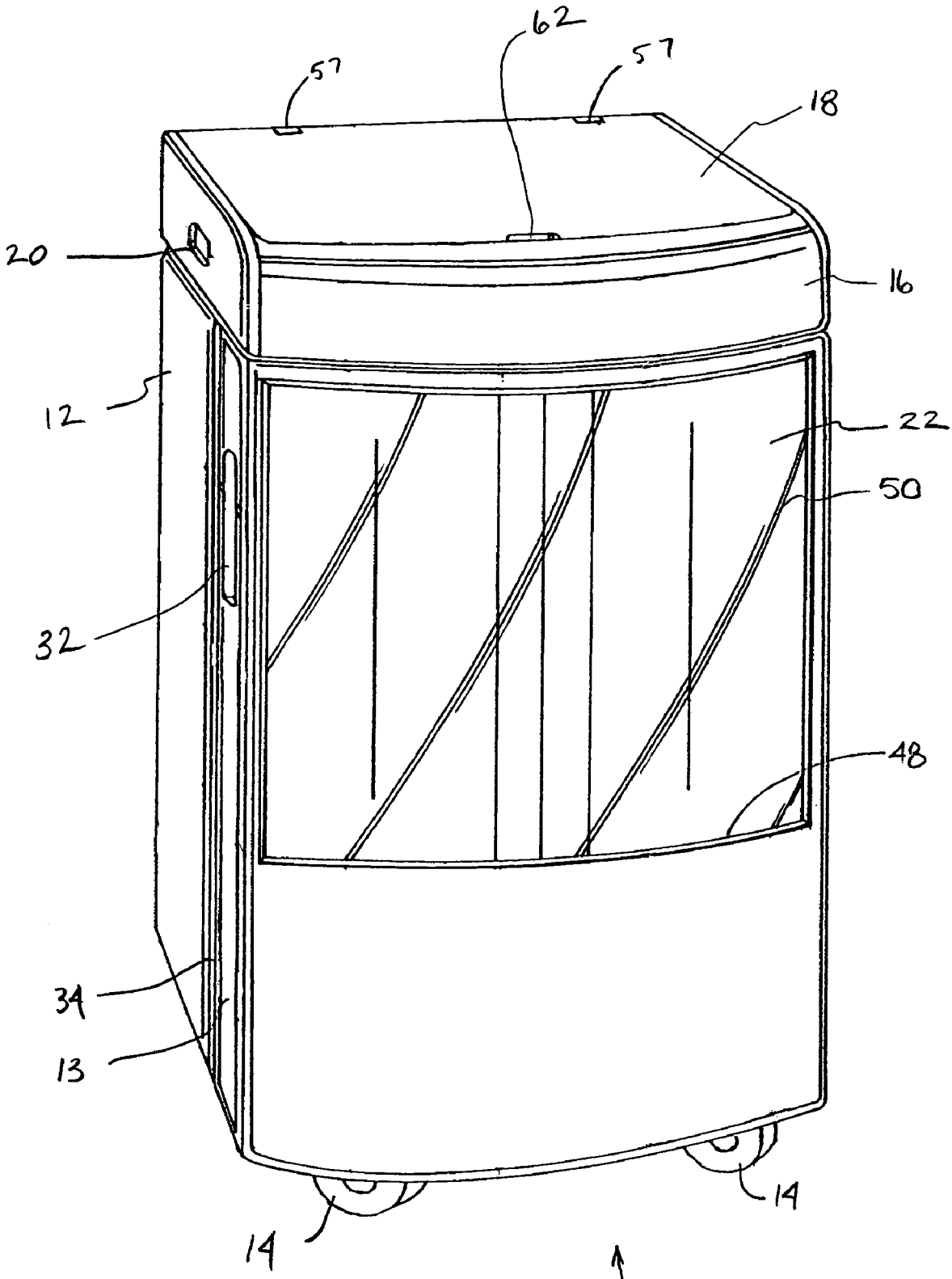
FIG. 1 is a perspective view of a portable refrigerator according to one embodiment of the present invention with a top lid in a closed position.
Figure 2:
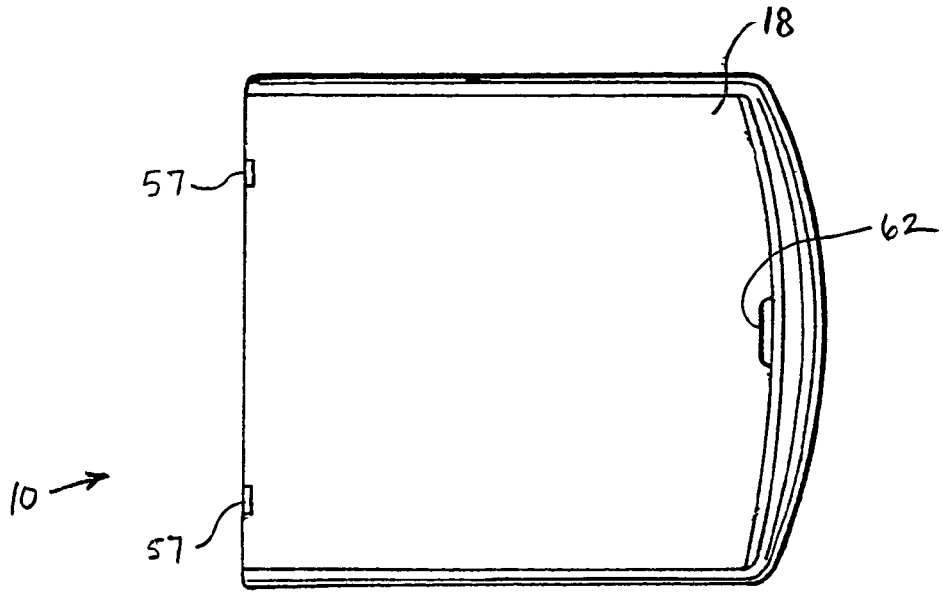
FIG. 2 is a top plan view of the refrigerator of FIG. 1.
Figure 3:
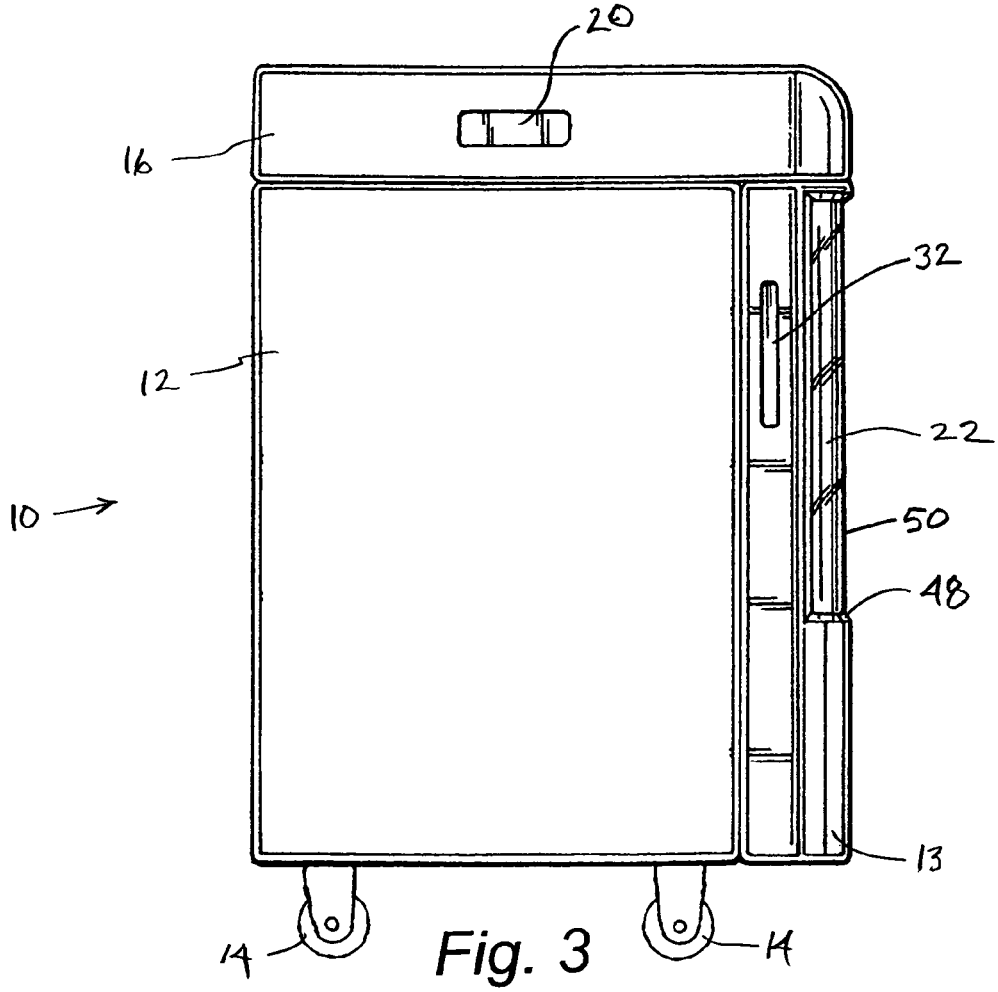
FIG. 3 is a side elevation view of the refrigerator of FIG. 1.

Shown generally in the drawings is a portable refrigerator 10. As seen in FIGS. 1-4, the refrigerator 10 includes a cabinet 12 that can be selectively closed with a door 13. Caster wheels 14 may be provided on the bottom of the refrigerator 10 to facilitate easy movement of the refrigerator 10 across a floor. A removable storage tray 16 is provided at the top of the cabinet 12. A flat lid 18 is attached to the storage tray 16 by hinges or other similar structure. Hand holds 20 may be provided along the sides of the removable storage tray 16 to facilitate lifting and carrying the storage tray 16. A removable display panel 22 may be provided on the front of the door 13. The display panel 22 may include a desired graphic image such as the logo or name of a favorite school or team.

Figure 10:
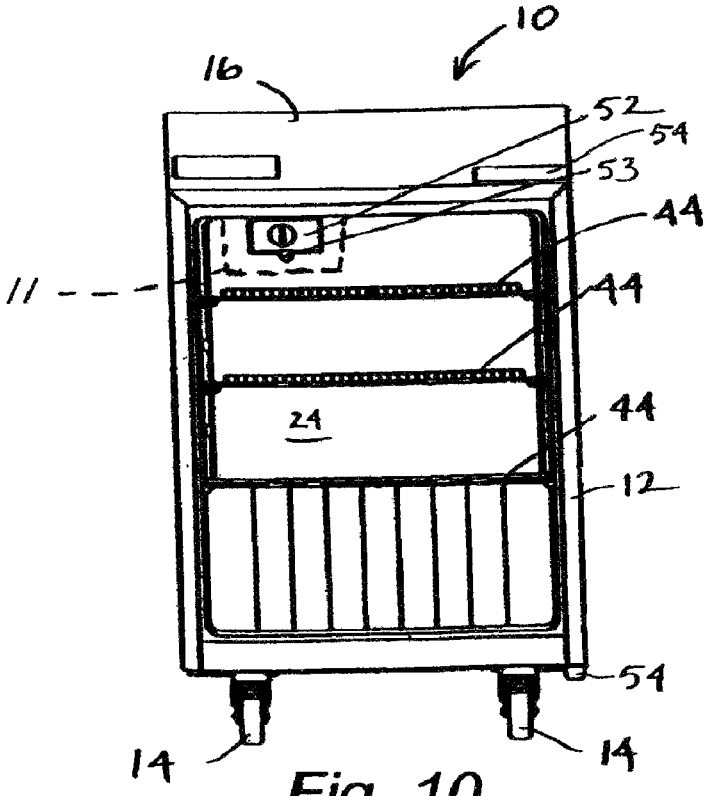
FIG. 10 is a front elevation view of the refrigerator of FIG. 1, with the door removed to reveal the storage compartment within the refrigerator.
Figure 11:
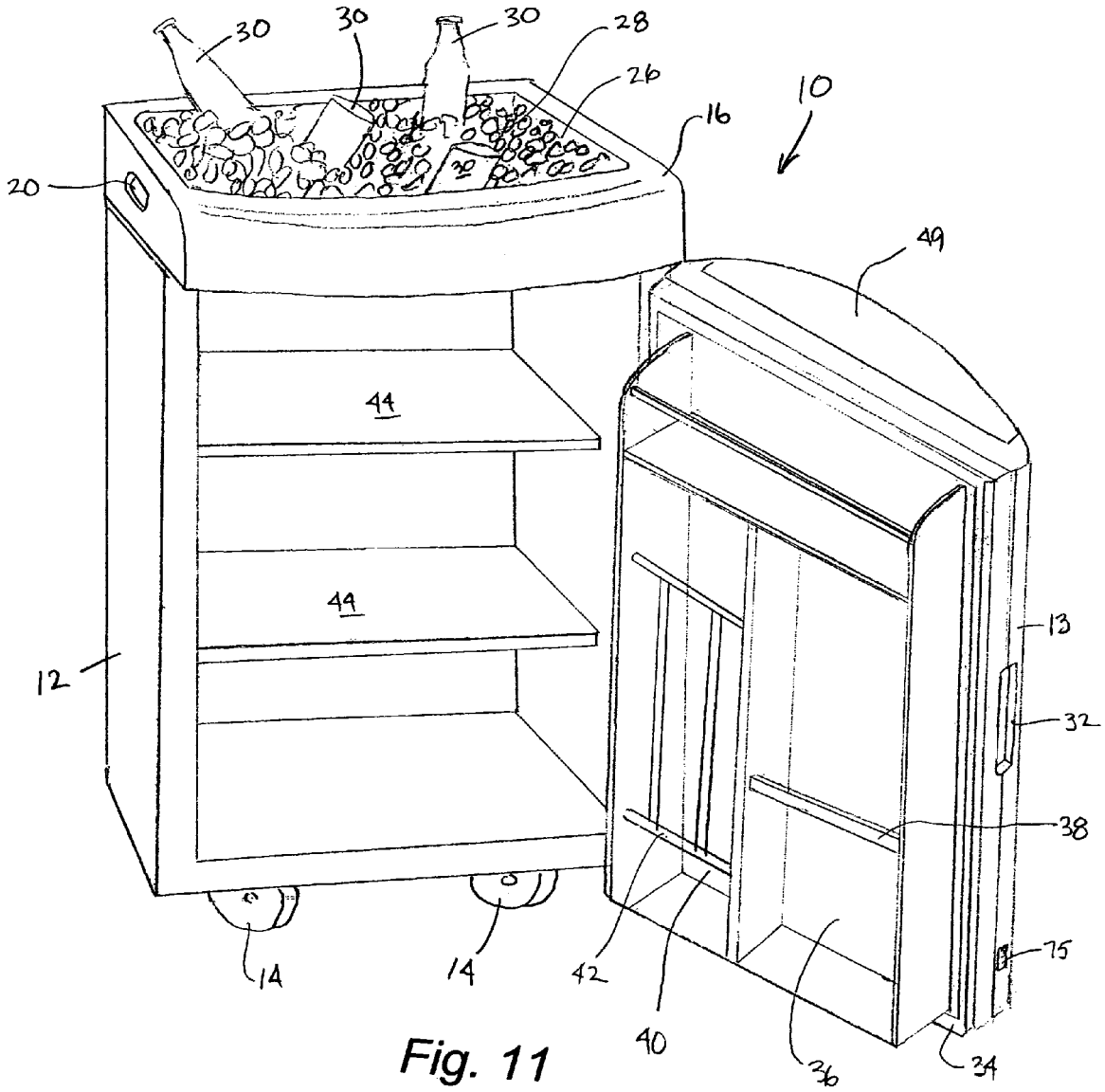
FIG. 11, is an isometric view of the refrigerator of FIG. 1, with the door in an open position and with ice and beverages in the tray portion.

Preferably the cabinet 12 and door 13 are insulated, and the interior of the cabinet 12 is a refrigerated storage space 24 (see FIGS. 10 & 11). The refrigerator 10 will include a chiller 11, or other means for cooling the storage space 24 to a desired temperature, typically somewhere between 35 and 40 degrees Fahrenheit. The storage space 24 may also include a small freezer portion for making and storing ice or other frozen foods. The refrigerator 10 is provided with a standard power cord (not shown) for connection with a power outlet via a standard plug. The power cord is used to provide electrical current to the chiller unit, and any lights provided on the refrigerator 10.

The door 13 is hinged to the cabinet 12 by hinges 54 (see FIG. 10). The hinges 54 may be reversibly mounted on either side of the cabinet 12 so that the door 13 may open from the left or right, as desired. The door 13 may be provided with a door handle 32 to facilitate opening and closing the door 13. Gaskets 34 may also be provided along the perimeter of the door 13 to provide an air tight seal between the door 13 and the cabinet 12. Optionally, the door 13 may be provided with a latch (not shown) to securely shut the door 13 against the cabinet 12. A locking mechanism controlled by a key may be provided if it is desired to secure the contents of the refrigerator 10; for example, if it is desired to make alcoholic beverages unavailable to younger members of the household.

Figure 5:
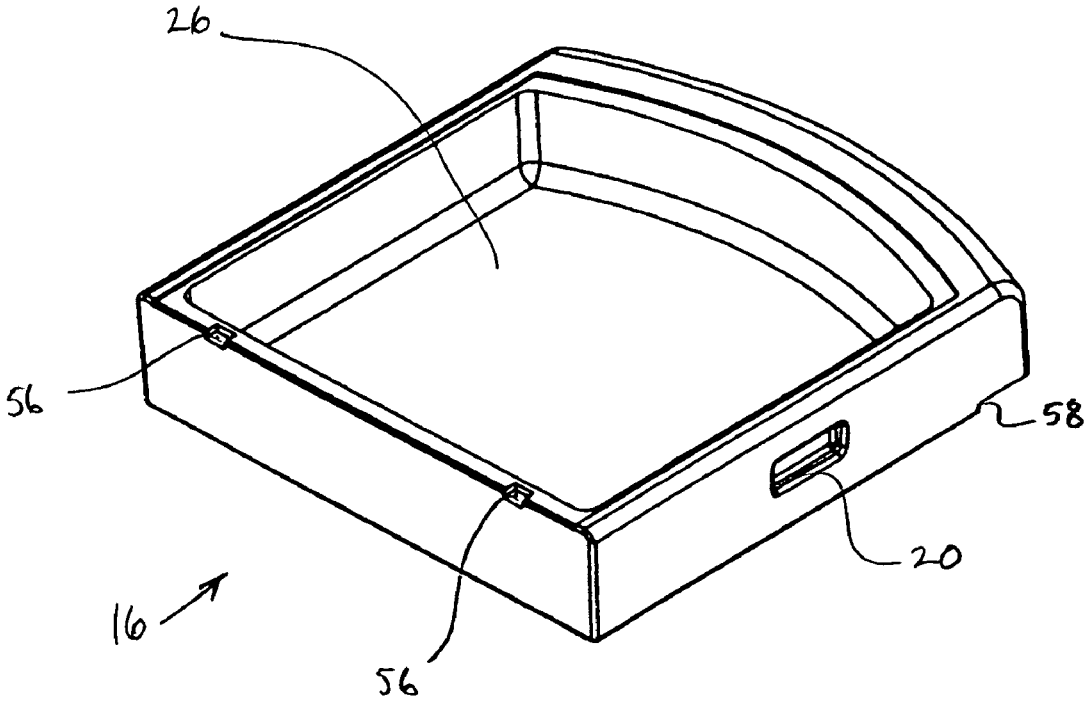
FIG. 5 is an isometric view of a tray portion of a refrigerator according to one embodiment of the present invention.
Figure 4:
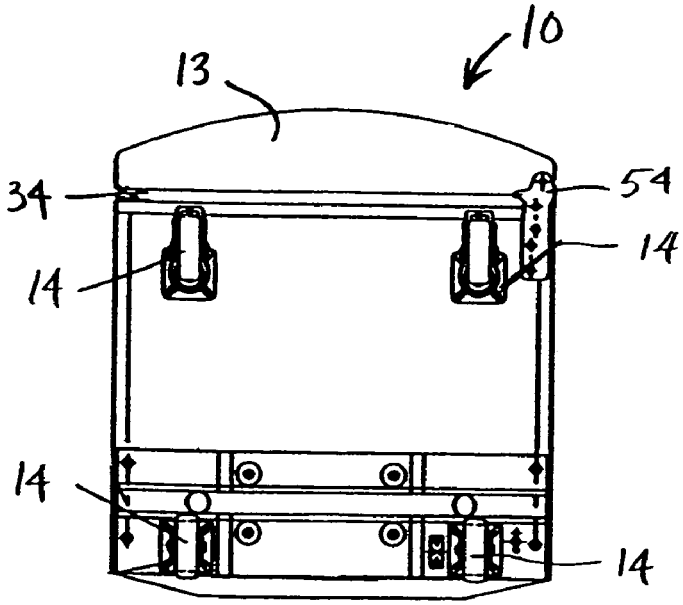
FIG. 4 is a bottom plan view of the refrigerator of FIG. 1.

FIG. 5 shows a storage tray 16 according to the present invention wherein the lid 18 has been removed to open a storage bin portion 26 of the storage tray 16. The storage bin 26 is recessed downwardly and faces upwardly such that it will hold ice or water without leaking. The storage bin portion 26 may therefore be filled with ice 28 and beverage containers 30 (see FIG. 11). The hand holds 20 permit the storage tray 16 to be easily lifted off of the cabinet 12 so that it may be carried to locations remote from the refrigerator 10. This permits the storage tray 16 to be carried to a convenient location for loading it with ice 20, and to use the storage tray 16 to serve the beverage containers 30 to people who are at a distance from the refrigerator 10. Rear hinge pockets 56 are provided at the top rear of the storage tray 16 as an attachment point for hinges 57 (not shown in FIG. 5, see FIG. 9) that engage the lid 18. Preferably the storage tray 16 has a flat bottom that is well suited for supporting the storage tray 16 when it is placed on a flat surface. A notch 58 is provided at the front of the storage tray to engage a lip (not shown) at the top of the cabinet 12 in order to retain the storage tray 16 in place on the top of the cabinet 12. Additional mating features may optionally be provided on the tray 16 and the top of the cabinet 12 to urge and maintain the tray 16 in proper orientation on top of the cabinet 12.

Preferably the storage tray 24 is formed by injection molded plastic, or other smooth durable material. The storage bin portion 26 of the storage tray 16 is also well suited for storing other small items such as compact discs (CDs), digital video discs (DVDs), and the like.

Figure 6:
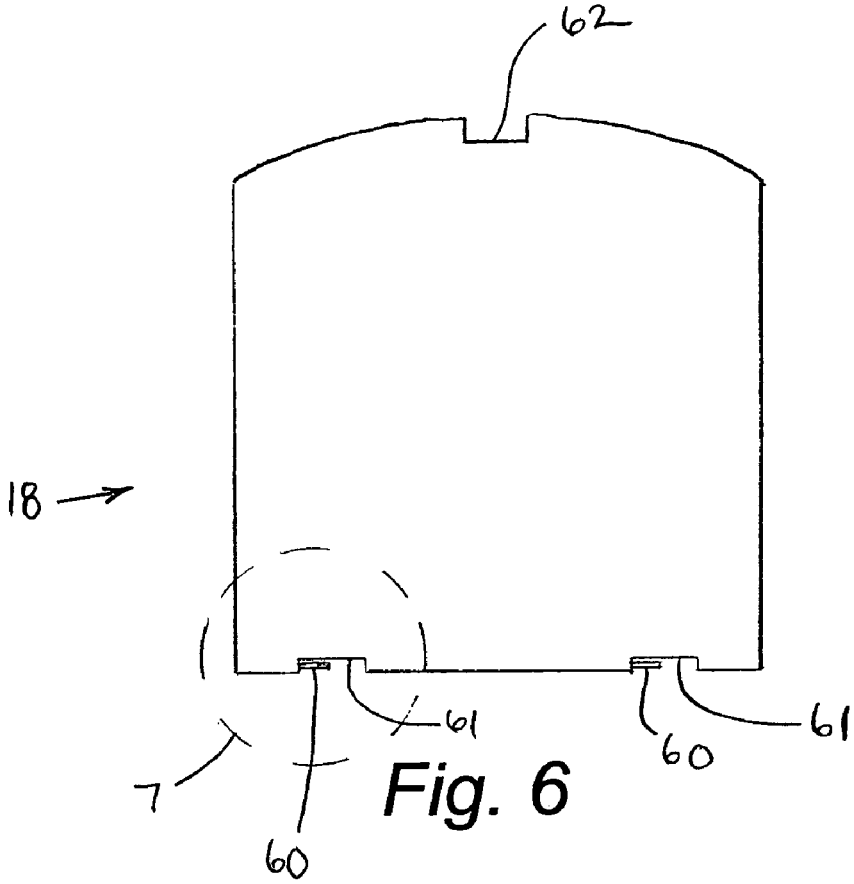
FIG. 6 is a top plan view of a lid for use with the tray portion of FIG. 5.
Figure 7:
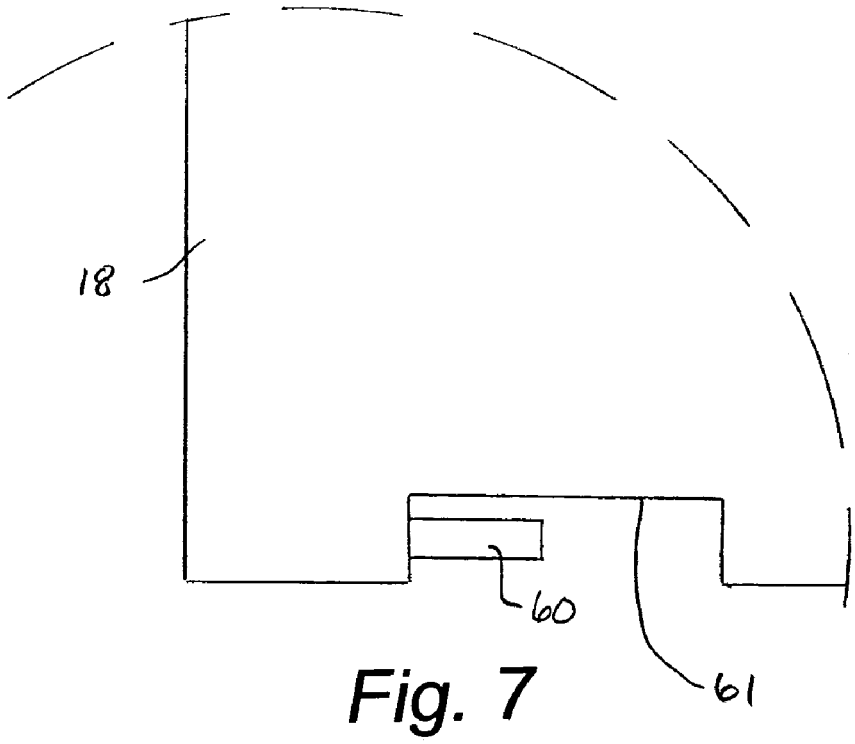
FIG. 7 is a fragmentary view of the lid of FIG. 6, taken along circle 7 of FIG. 6.

FIGS. 6 and 7 show the details of the lid 18. Hinge posts 60 are provided along the rear edge of the lid 18. These hinge posts 60 may take the form of round pins that extend parallel with the rear edge of the lid 18 within notches 61. The hinge posts 60 may be metal or other hard material, or may be monolithically molded as part of the lid 18. The hinge posts 60 can selectively be brought into mating engagement with the hinges 57 that mount in hinge pockets 56 provided on the storage tray 16. Therefore, the lid 18 may be easily mounted and removed from the storage tray 16 by inserting or removing the hinge posts 60 from the hinges 57. A cut out portion 62 may be provided at the front of the lid 18 to act as a grip to aid in lifting the lid 18 from its closed position on the storage tray 16.

Figure 8:
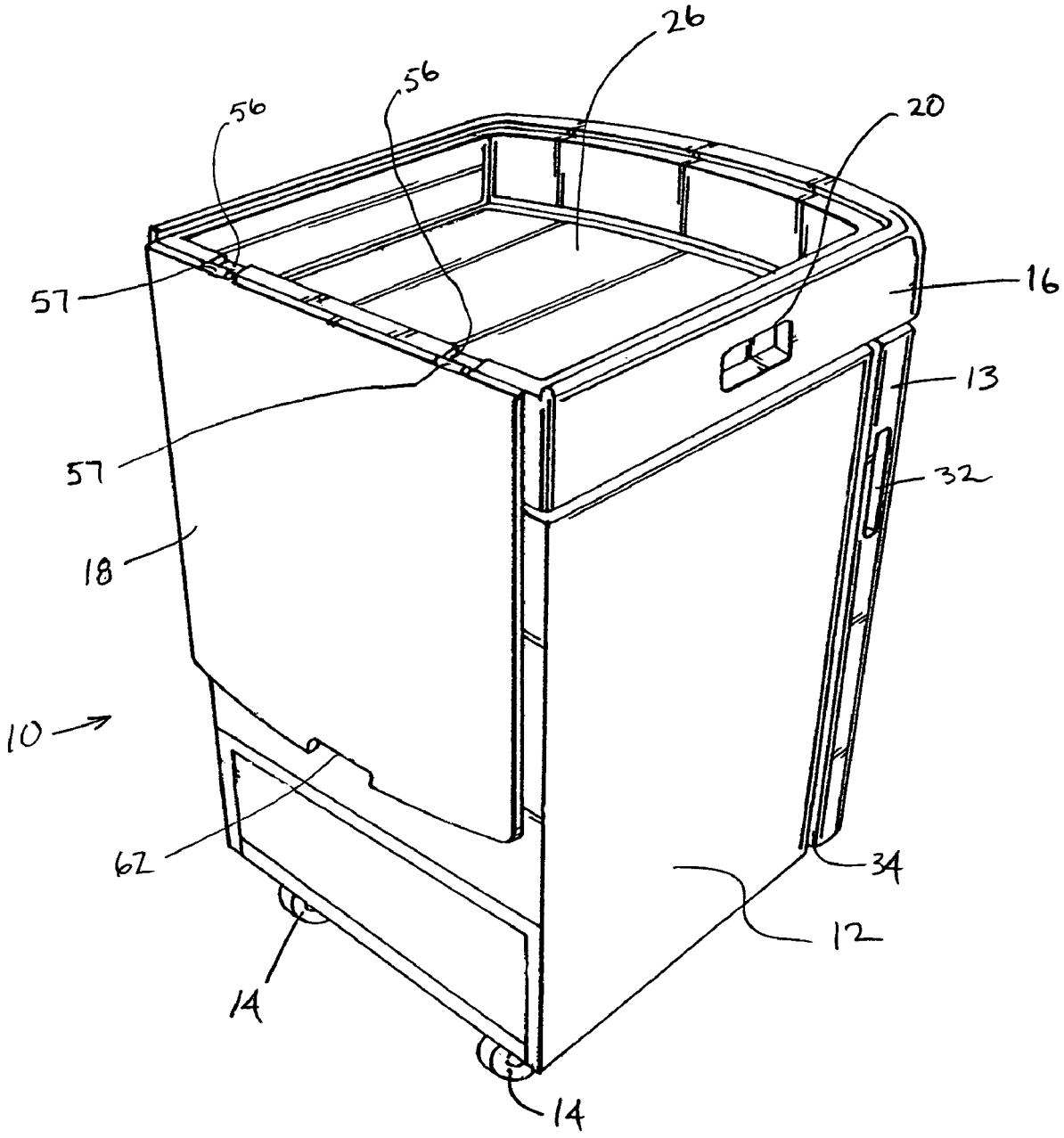
FIG. 8 is a perspective of the refrigerator of FIG. 1, with the lid adjusted to an open position.
Figure 9:
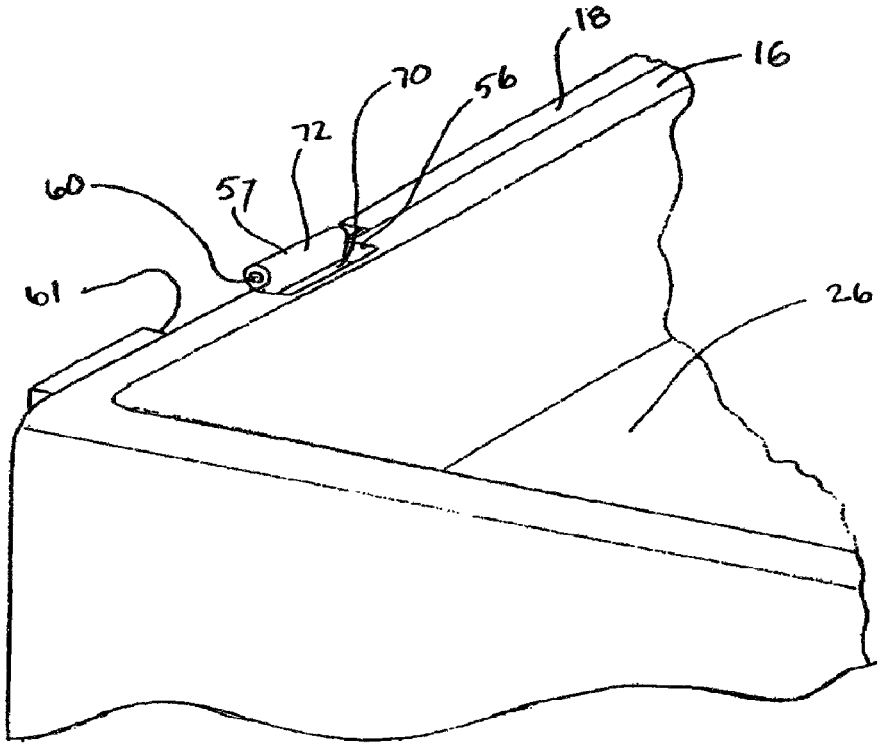
FIG. 9 is a fragmentary detail view of a hinge portion of FIG. 8.

The lid 18 may be adjusted between the closed position shown in FIGS. 1-4 and an open position wherein the lid has been rotated around its hinges 60 until it lies flat along the back of the refrigerator 10, as best seen in FIGS. 8 & 9. In the closed position, the lid 18 rests on top of the storage tray 16, and generally covers and encloses the storage bin portion 26. In this fashion the lid 18 prevents dust and other debris from collecting in the storage bin portion 26. It also permits small items such as compact discs and digital video discs to be stored in the storage bin portion 26 and hidden from view by the lid 18. In the closed position, the lid also acts as a bearing surface for supporting drinks, knick knacks, and the like. When the lid 18 is flipped back into the open position of FIGS. 8 & 9, ice 28 and beverage containers 30 (see FIG. 11) may be placed within the storage bin portion 26 for convenient access. Preferably, the lid 18 is easily completely removed from the storage tray 16 so that the storage tray 16 may be lifted off of the cabinet 12 and carried without interference by the lid 18.

FIG. 9 shows a detail of the hinge 57. The hinge 57 includes a mounting plate 70 that attaches to the pocket 56 and a female portion 72 that extends generally above and behind the top rear edge of the storage tray 16. The hinge post 60 of the lid 18 is received within the female portion 72 such that the lid 18 will rotate about the hinge post 61 captured within the female portion 72. The notches 61 permit the hinge post 60 to be brought into alignment with the female portion 72 for attaching the lid 18 to the storage tray 16, and permit the lid 18 to be slid laterally to disengage the hinge post 70 from the female portion 72 to remove the lid 18. It should be appreciated that the male and female portions could be reversed.

FIG. 10 shows a front view of an embodiment of a refrigerator 10 according to the present invention with its door 13 removed. A thermostat 52 can be seen in the storage space 24 which allows a user to control the temperature within the storage space 24. The thermostat 52 may be mounted to a rear wall by mounting screw 53. Shelves 44 provide surfaces for supporting items within the refrigerated storage space 24.

FIG. 11 shows a refrigerator 10 according to one embodiment of the present invention with its door 13 open to show the refrigerated storage space 24. A small light might be provided within the storage space 24 to illuminate the contents of the refrigerator 10 when the door 13 is opened. Preferably the interior portion of the door 13 is configured to retain beverage containers 30. For example, a large bottle containing compartment 36 may be molded into the interior of the door 13, and provided with a bar 38 to hold large bottles. A can dispensing compartment 40 may also be formed on the inside of the door 13 with a wire frame 42 provided to retain the cans in the dispensing compartment 40. The cans 30 may be stacked vertically within the can dispensing compartment 40 and removed one at a time at the bottom of the dispensing compartment 40. Shelves 44 may be provided within the storage space 24 for supporting beverage containers 30 or other items.

At least three caster wheels 14 are provided on the bottom of the refrigerator 10 to support the refrigerator 10, and to allow for easy mobility of the refrigerator 10. In a preferred embodiment, the two caster wheels 14 at the rear of the refrigerator 10 have a fixed orientation, but the two caster wheels 14 located at the front of the refrigerator 10 are swivelable. A preferred design for the front caster wheels 14 include an adjustable locking lever that can be adjusted to lock a brake attached to the front caster wheels 14 that prevents them from rotating.

The display panels 22 may take the form of thin sheets printed or otherwise marked with a desired pattern, such as a team name and logo. In the preferred embodiment the display panel 22 is easily removable and replaceable from the door 13. This may be done, for example, by providing a pocket 48 within the door 13 for retaining a display panel 22. An access cover 49 (see FIG. 11) may be provided to provide access to the pocket 48. The access cover 49 may be hinged to the door 13, or may attach with mating clips or the like. A permanent transparent panel 50 may be provided on the front of the door 13 to form the front portion of the pocket 48. Alternatively, the display panel 22 may be held in place on the door 13 by C-shaped brackets provided on the exterior of the door 13. Those of skill in the art will be aware of several acceptable mechanisms for attaching display panels 22 to a door 13.

In a preferred embodiment the display panel 22 is made of a translucent material, and a light, such as a florescent light, is provided within the door 13 to provide back lighting for the translucent panel 22. Electricity may be provided to the florescent light through the power cord. A switch 75 may be provided to selectively turn the back lighting on and off. A user may have several display panels 22 that can be interchanged depending on the season and desires of the user.

In an alternative embodiment not shown in the drawings, the storage tray 16 is reversible by flipping it so that the storage bin portion 26 faces downwards towards the cabinet 12. In this manner, the storage bin portion 26 is protected from dust and debris. A storage space may be available between the inverted storage bin portion 26 of the storage tray 16 and the top of the cabinet 12. When it is desired to use the storage tray 16 as a serving tray, the storage tray may be flipped over so that the storage bin portion 26 faces upward.

Therefore, it can be seen that the present invention provides an improved refrigerator 10 that is especially well suited for use in entertaining. It provides improved aesthetics in the form of replaceable and customizable panels 22 that may be backlit to give an overall impression that is evocative of a vending machine. Furthermore, the removable tray 16 serves several functions. It can be easily removed from the refrigerator 10 and be passed around as a serving tray. It can be removed from the refrigerator 10 and loaded with ice and refreshments so that the refreshments are readily available and displayed without the need to open the refrigerator. Alternatively, the storage space 26 in the tray 16 may be filled with CDs, DVDs, unrefrigerated snack foods, and the like. A removable lid 18 can be attached to the tray 16 and used to cover storage space 26 to provide an uncluttered appearance, and protect the contents of the storage space 26 from collecting dust and the like.

Although various representative embodiments of this invention have been described above with a certain degree of particularity, those skilled in the art could make numerous alterations to the disclosed embodiments without departing from the spirit or scope of the inventive subject matter set forth in the specification and claims. It is intended that all matter contained in the above description or shown in the accompanying drawings shall be interpreted as illustrative only and not limiting. Changes in detail or structure may be made without departing from the spirit of the invention as defined in the appended claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention.

We claim:

1. A compact refrigerator appliance comprising:

a first component comprising a thermally insulated cabinet having side walls surrounding a first axis, a bottom wall transverse to the first axis, and a top wall transverse to the first axis, the walls defining and enclosing a refrigerated interior storage space;

one of the side walls comprising a door hingedly connected and pivotable relative to at least one other side wall for selectively blocking or unblocking access to the interior storage space from a direction generally transverse to the first axis;

a refrigeration unit operatively connected to the cabinet for cooling the interior storage space;

a second component removably mountable over at least a portion of the to wall of said cabinet without interference with pivoting of the door, said second component having side walls surrounding a second axis, and a bottom wall transverse to the second axis, the side and bottom walls defining and surrounding a liquid tight storage space adapted to hold liquids without leaking and haying an upper opening to the storage space generally traverse to the second axis;

a lid hingedly attached to the second component for enclosing the upper opening in a closed position and lying substantially flat along a back wall of the thermally insulated cabinet in an open position; and said top wall of the first component and the bottom wall of the second component each having at least one contoured portion defining complimentary mating surfaces for guiding and maintaining said second component in a pre-determined orientation on the top wall of said cabinet, and when the second component is mounted to the first component, the first axis is generally parallel to the second axis and access to the storage space of the second component is generally parallel to the first and second axes.

2. The compact refrigerator appliance according to claim 1, wherein the lid is selectively removable from the second component without the use of tools.

3. A compact refrigerator appliance comprising:

a first component comprising a thermally insulated cabinet having side walls surrounding a first axis, a bottom wall transverse to the first axis, and a top wall transverse to the first axis, the walls defining and enclosing a refrigerated interior storage space;

a plurality of casters attached to the bottom wall of the insulated cabinet to enable the insulated cabinet to be readily moved along a supporting surface;

one of the side walls comprising a door hingedly connected and pivotable relative to at least one other side wall for selectively blocking or unblocking access to the interior storage space from a direction generally transverse to the first axis;

a refrigeration unit operatively connected to the insulated cabinet for cooling the interior storage space;

a second component removably mountable over at least a portion of the top wall of said cabinet without interference with pivoting of the door, said second component having side walls surrounding a second axis, and a bottom wall transverse to the second axis, the side and bottom walls defining and surrounding a storage space and having an upper opening to the storage space generally traverse to the second axis; and said top wall of the first component and the bottom wall of the second component each having at least one contoured portion defining complimentary mating surfaces for guiding and maintaining said second component in a pre-determined orientation on the top wall of said cabinet, and when the second component is mounted to the first component, the first axis is generally parallel to the second axis and access to the storage space of the second component is generally parallel to the first and second axes, wherein the at least one contoured portion of the bottom wall of the second component comprises a notch formed in the bottom wall and the at least one contoured portion of the top wall of the first component comprises a lip, said notch matingly engaging the lip to maintain the second component in the pre-determined orientation, and wherein the side walls of the second component are substantially aligned with the side walls of the insulated cabinet, as well as a front face of the door, such that the second component appears integral with the insulated cabinet, is supported entirely by the insulated cabinet, and extends above while being spaced from the door so as to not interfere with movement of the door.

4. A compact portable refrigerator with a removable outer storage tray comprising:

an insulated cabinet including a top wall having a contoured mating surface, a bottom wall, a back wall and opposing side walls defining an internal refrigerated storage space;

a plurality of casters attached to the bottom wall of the insulated cabinet to enable the insulated cabinet to be readily moved along a supporting surface;

a door having a front face, the door being movably attached to the cabinet for selective movement between an open position providing access to the refrigerated storage space, and a closed position; and a storage tray including a base and at least one side wall projecting from the base collectively defining a liquid tight, storage bin portion accessible through an upper opening and adapted to hold liquid without leaking, the base including a contoured mating portion that complimentarily engages the contoured mating surface of the insulated cabinet to releasably register the storage tray in a storage position on top of the insulated cabinet while enabling the storage tray to be removed from upon the insulated cabinet, wherein the at least one side wall of the storage tray is substantially aligned with the back and opposing side walls of the insulated cabinet, as well as the front face of the door, when in the storage position such that the storage tray appears integral with the insulated cabinet, is supported entirely by the cabinet, and extends above while being spaced from the door so as to not interfere with the movement of the door, wherein the storage tray further includes a lid hingedly attached to the at least one side wall for pivotable movement between a closed position covering the upper opening of the storage tray, and an open position wherein the lid lies substantially flat against the back wall of the insulated cabinet.

5. The compact portable refrigerator of claim 4, wherein the door includes a pocket formed therein and a light transmissive front panel removably retained within the pocket.

6. The compact portable refrigerator of claim 5, further comprising a light adapted to provide back lighting for the light transmissive front panel, and a switch mounted on a side of the door enabling a user to selectively activate the light.

7. The compact portable refrigerator of claim 5, further comprising an access cover movably mounted to enable a user to selectively access the pocket.

8. The compact portable refrigerator of claim 4, wherein the lid is selectively detachable from the at least one side wall of the storage tray without the use of tools.

9. The compact portable refrigerator of claim 4, wherein the lid includes a cut-out portion to aid a user in lifting the lid from the closed position to the open position.

* * * * *

UNITED STATES PATENT AND TRADEMARK OFFICE

CERTIFICATE OF CORRECTION

PATENT NO. : 8,038,235 B2
APPLICATION NO. : 11/269487
DATED : October 18, 2011
INVENTOR(S) : Frederick M. Lowery et al.

It is certified that error appears in the above-identified patent and that said Letters Patent is hereby corrected as shown below:

Col. 5, line 53 - Col. 6, line 21, Claim 1: "A compact refrigerator appliance comprising: a first component comprising a thermally insulated cabinet having side walls surrounding a first axis, a bottom wall transverse to the first axis, and a top wall transverse to the first axis, the walls defining and enclosing a refrigerated interior storage space; one of the side walls comprising a door hingedly connected and pivotable relative to at least one other side wall for selectively blocking or unblocking access to the interior storage space from a direction generally transverse to the first axis; a refrigeration unit operatively connected to the cabinet for cooling the interior storage space; a second component removably mountable over at least a portion of the to wall of said cabinet without interference with pivoting of the door, said second component having side walls surrounding a second axis, and a bottom wall transverse to the second axis, the side and bottom walls defining and surrounding a liquid tight storage space adapted to hold liquids without leaking and haying an upper opening to the storage space generally traverse to the second axis; a lid hingedly attached to the second component for enclosing the upper opening in a closed position and lying substantially flat along a back wall of the thermally insulated cabinet in an open position; and said top wall of the first component and the bottom wall of the second component each having at least one contoured portion defining complimentary mating surfaces for guiding and maintaining said second component in a pre-determined orientation on the top wall of said cabinet, and when the second component is mounted to the first component, the first axis is generally parallel to the second axis and access to the storage space of the second component is generally parallel to the first and second axes."
should be Claim 1: --A compact refrigerator appliance comprising: a first component comprising a thermally insulated cabinet having side walls surrounding a first axis, a bottom wall transverse to the first axis, and a top wall transverse to the first axis, the walls defining and enclosing a refrigerated interior storage space; one of the side walls comprising a door hingedly connected and pivotable relative to at least one other side wall for selectively blocking or unblocking access to the interior storage space from a direction generally transverse to the first axis; a refrigeration unit operatively connected to the cabinet for cooling the interior storage space; a second component removably mountable over at least a portion of the top wall of said cabinet without interference with pivoting of the door, said second Signed and Sealed this
Twenty-eighth Day of August, 2012

David J. Kappos

David J. Kappos
*Director of the United States Patent and Trademark Office* component having side walls surrounding a second axis, and a bottom wall transverse to the second axis, the side and bottom walls defining and surrounding a liquid tight storage space adapted to hold liquids without leaking and having an upper opening to the storage space generally traverse to the second axis; a lid hingedly attached to the second component for enclosing the upper opening in a closed position and lying substantially flat along a back wall of the thermally insulated cabinet in an open position; and said top wall of the first component and the bottom wall of the second component each having at least one contoured portion defining complimentary mating surfaces for guiding and maintaining said second component in a pre-determined orientation on the top wall of said cabinet, and when the second component is mounted to the first component, the first axis is generally parallel to the second axis and access to the storage space of the second component is generally parallel to the first and second axes.--